United States Patent [19]

Aoki et al.

[11] 4,186,635

[45] Feb. 5, 1980

[54] ELECTRONIC MUSICAL INSTRUMENT

[75] Inventors: Eiichiro Aoki; Akira Nakada, both of Hamamatsu, Japan

[73] Assignee: Nippon Gakki Seizo Kabushiki Kaisha, Hamamatsu, Japan

[21] Appl. No.: 812,377

[22] Filed: Jul. 1, 1977

[30] Foreign Application Priority Data

Jul. 9, 1976 [JP] Japan ..... 51/81516

[51] Int. Cl.[2] ..... G10H 1/00; G10H 5/00

[52] U.S. Cl. ..... 84/1.01; 84/1.03

[58] Field of Search ..... 84/1.01, 1.22, 1.03, 84/1.13; 364/701, 718; 328/13, 14, 48, 59, 63; 307/271, 227, 228; 331/1 A, 11 R; 340/347 PA; 365/73; 235/92 SH

[56] References Cited

U.S. PATENT DOCUMENTS

| | | | |
|---|---|---|---|
| 3,670,801 | 10/1971 | Fredkin | 84/1.03 |
| 3,831,015 | 8/1974 | Hoff, Jr. | 235/197 |
| 3,851,265 | 11/1974 | Young, Jr. | 328/140 |
| 3,878,750 | 4/1975 | Kapps | 84/1.01 |
| 3,882,403 | 5/1975 | Gerken | 328/14 |
| 4,003,003 | 1/1977 | Haeberlin | 332/11 R |
| 4,048,480 | 9/1977 | Minot | 235/152 |

*Primary Examiner*—Vit W. Miska

*Attorney, Agent, or Firm*—Spensley, Horn, Jubas & Lubitz

[57] ABSTRACT

In an electronic musical instrument, numerical values corresponding to respective notes are generated on a time-shared basis, the generated numerical values are cumulatively added for each note in synchronism with a predetermined time slot and carry signals coming out as results of the accumulations of the respective numerical values respectively constitute note frequency signals. By simplifying a tone source circuit in this manner and by selecting generated frequency signals in accordance with depression of keys, the number of conductors connecting a keyboard circuit with the tone source circuit can be reduced.

3 Claims, 4 Drawing Figures

ELECTRONIC MUSICAL INSTRUMENT

BACKGROUND OF THE INVENTION

This invention relates to an improvement of an electronic musical instrument of a type having tone sources which generate note frequency signals having shapes defining frequencies of the tone pitches of respective notes to be played by the keys on the keyboard.

A prior art electronic musical instrument having tone sources which generate note frequency signals having shapes defining frequencies of the tone pitches of respective notes to be played by the keys and selecting a required one or ones of such note frequency signals in response to depression of a key or keys must feed tone source signals of a number corresponding to a total number of keys on the keyboard (e.g. 61 tone source outputs if there are 61 keys) individually from these tone sources to a keyboard circuit. Accordingly, this type of instrument requires the same number of connection wires connecting the keyboard circuit and the tone sources as the number of the keys. This causes a problem in designing a portion of the instrument (except for the keyboard circuit) in an integrated circuit configuration since the integrated circuit requires a large number of connection pins (e.g. 61 if there are 61 keys) for connection with the keyboard circuit. Increase in the number of pins in the integrated circuit results in increase in the cost of manufacturing of the electronic musical instrument.

To eliminate the above described disadvantage in the prior art electronic musical instrument, the assignee of the present invention has proposed in U.S. patent application Ser. No. 671861 an electronic musical instrument capable of digitally processing signals in all circuits therein including a keyboard circuit and other circuits connected thereto for facilitating an integrated circuit design. In this proposed instrument, the tone source circuit includes twelve oscillators respectively generating note frequency signals having shapes respectively defining frequencies of twelves notes C through B of the highest octave and twelve sets of frequency dividing circuits each set of which divides in frequency the note frequency signal generated by a corresponding one of these oscillators sequentially for producing note frequency signals for a plurality of octaves for each of the notes C through B. This proposed circuit, however, is considerably complicated in construction and a further improvement has been desired.

SUMMARY OF THE INVENTION

It is, therefore, an object of the invention to provide a compact and low-cost electronic musical instrument suitable for an integrated circuit configuration with a simplified tone source circuit and a reduced number of conductors between the tone source circuit and the keyboard circuit.

According to the invention, the electronic musical instrument comprises a tone source circuit cumulatively adding numerical values (frequency numbers) corresponding to frequencies of musical notes at each predetermined time and providing, on a time-shared basis, note frequency signals having shapes respectively defining the frequencies of the respective notes by carry signals generated as a result of the cumulative addition, and a tone selection circuit for selecting the note frequency signals outputted from the tone source circuit in accordance with depression of keys.

DESCRIPTION OF A PREFERRED EMBODIMENT

Figure 1:
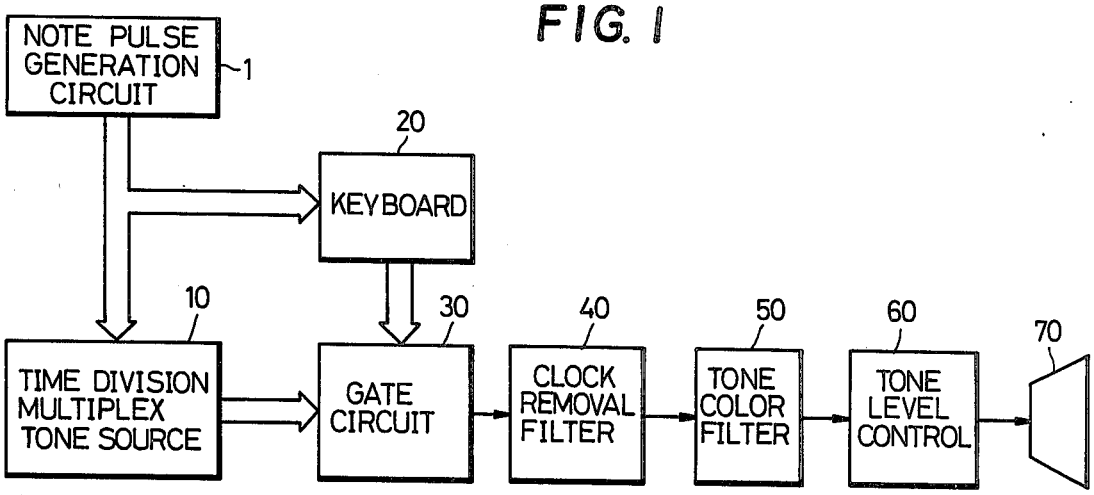
FIG. 1 is a block diagram schematically showing an embodiment of the electronic musical instrument according to the invention.

Referring first to FIG. 1, a note-name pulse generation circuit 1 successively produces a train of note pulses each designating the timing for each one of twelve notes (C, C SM . . . B) in the chromatic scale. The note pulses are applied to a time division multiplex tone source circuit 10 which comprises a 12-stage shift register and outputs, in time division, note frequency signals having shapes respectively defining the frequencies of the tone pitches of respective notes to be played by the keys in synchronism with the note pulses.

The note pulses generated by the circuit 1 are applied also to a keyboard circuit 20. The keyboard circuit 20 comprises matrix circuitry consisting of note buses (row) representing the respective notes and octave buses (column) representing octaves, with key switches for the respective keys disposed at corresponding locations (intensection of rows and columns) in the matrix circuitry. The note pulses are applied to the note buses of the matrix circuitry and a note pulse corresponding to a key switch of a depressed key is delivered out of one of the octave buses representing the octave to which the depressed key belongs. This note pulse corresponding to the octave of the depressed key is fed to a gate circuit 30 for enabling the gate circuit 30 to periodically select the time division multiplexed note frequency signal corresponding to the respective keys and supplied from the time division multiplex tone source circuit 10. The output of the gate circuit 30 is applied to a clock removal filter 40 which passes signals of audio frequencies only. In the clock removal filter 40, a high frequency (i.e. produced at a high rate of time division) note pulse component in the note frequency signal is removed and a tone of a frequency defining the tone pitch of each key is extracted. The output tone signal is applied to a tone color control filter 50 and a tone level (volume) control circuit 60 for tone color and loudness controls and thereafter is supplied to an audio system 70 for sounding of a musical tone.

Figure 2:
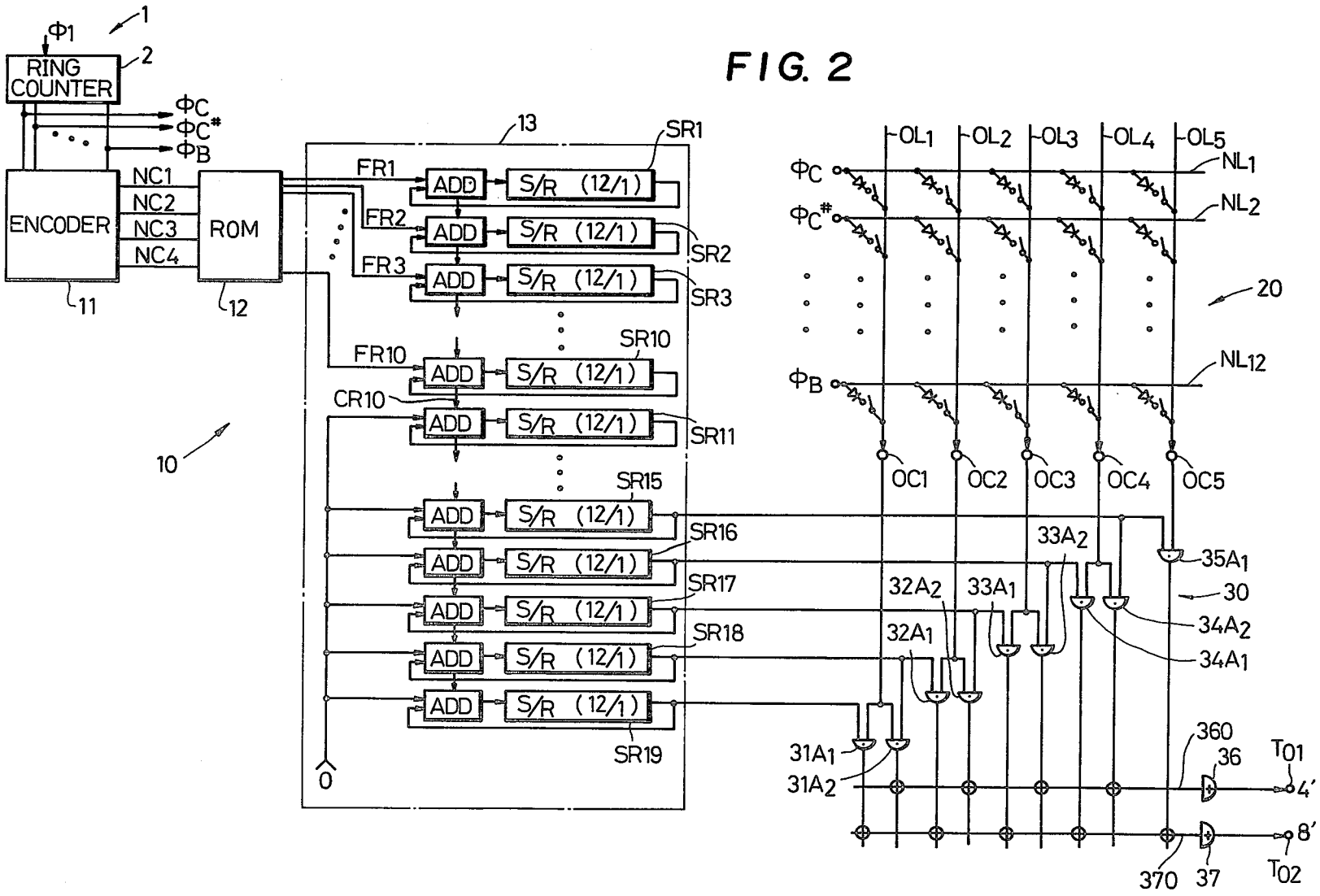
FIG. 2 is a block diagram showing an essential portion of the embodiment in detail in connection with a keyboard circuit.

FIG. 2 is a block diagram showing an essential portion of the electronic musical instrument according to the invention. The note pulse generation circuit 1 comprises a clock pulse oscillator (not shown) for generating a clock pulse $\phi_1$ and a 12-stage ring counter 2 counting the clock pulse $\phi_1$. The period of the clock pulse $\phi$ is 1.13 microseconds, and therefore the circulation period of the ring counter 2 is $12 \times 1.13 = 13.56$ microseconds.

Respective stage outputs of the ring counter 2 constitute twelve note pulses $\phi_C$, $\phi_{C\#}$. . . $\phi_B$. The note pulses $\phi_C$ through $\phi_B$ are pulses respectively occupying sequentially staggered time slots of 1.13 microseconds and being generated sequentially and circulatingly with a repetition period of 13.56 microseconds.

These note pulses $\phi$ through $\phi_B$ are time division synchronizing signals and the time division multiplex tone source circuit 10 and the gate circuit 30 are operated on the time-shared basis in synchronism with the note pulses $\phi_C$ through $\phi_B$.

The time division multiplex tone source circuit 10 comprises an encoder 11 which encodes each of the note pulses $\phi_C$ through $\phi_B$ into a 4-bit note code NC1 through NC4 a read-only memory 12 which sequentially provides 10-bit note frequency information FR1 through FR10 in response to the note code NC1 through NC4, and a digital tone generator 13 which produces a note frequency signal corresponding to each note in response to the read out frequency information FR1 through FR10.

The encoder 11 outputs a note code NC1 through NC4 corresponding to each of the note pulses $\phi_C$ through $\phi_B$ in synchronism with the note pulses $\phi_C$ through $\phi_B$ Alternatively stated, the encoder 11 outputs a new note code at each time slot (1.13 microseconds) of the note pulses $\phi_C$ through $\phi_B$.

The note code NC1 through NC4 is applied to the read-only memory 12 and the frequency information FR1 through FR10 is read out every 1.13 microseconds. Relationship between the input note code NC1 through NC4 and the output frequency information FR1 through FR10 of the read-only memory 12 is shown in the following Table 1:

tone generator 13. The digital tone generator 13 is a time-division-multiplexed accumulator composed of plural stages (for respective digits) of circuits each circuit consisting of a binary adder and a 12-stage shift register. The frequency information bits FR1 through FR10 are respectively applied to the adders of the first through tenth stages. A pulse signal is delivered out from a carry output CR10 of the tenth stage as the accumulated result of the frequency information signal separately for each time slot and this output pulse signal from the carry output CR10 is frequency-divided by two by each one of the eleventh through fifteenth stages (i.e. by binary adders) to finally produce a square wave (but time-shared in twelve) note frequency signal corresponding to the specific note in the highest octave from the output of a shift register SR15 of the fifteenth stage. This square wave frequency signal is frequency-divided by two at each one of the sixteenth through nineteenth stages to produce note frequency signals corresponding to the same-named notes in respective octaves.

Assume now that a tone for the note A is to be produced. The read-only memory 12 produces frequency information $FR_A$ (0111000011) corresponding to the note A at each allotted time slot of 1.13 microseconds once every cycle (13.56 microseconds) of the ring counter 2. This frequency information $FR_A$ consisting of ten bits is applied to respective adders of the first through tenth stages of the digital tone generator 13. The digital tone generator 13 cumulatively adds the frequency information $FR_A$ applied thereto every 13.56 microseconds.

Table 1

| | Note code | | | | Frequency information | | | | | | | | | | |
|---|---|---|---|---|---|---|---|---|---|---|---|---|---|---|---|
| | NC1 | NC2 | NC3 | NC4 | FR1 | FR2 | FR3 | FR4 | FR5 | FR6 | FR7 | FR8 | FR9 | FR10 | $R_{NO}$ |
| C | 1 | 0 | 0 | 0 | 0 | 1 | 0 | 0 | 0 | 1 | 0 | 1 | 1 | 1 | 930 |
| B | 0 | 1 | 0 | 0 | 0 | 1 | 1 | 1 | 0 | 1 | 1 | 0 | 1 | 1 | 878 |
| A# | 1 | 1 | 0 | 0 | 1 | 0 | 1 | 1 | 1 | 1 | 0 | 0 | 1 | 1 | 829 |
| A | 0 | 0 | 1 | 0 | 0 | 1 | 1 | 1 | 0 | 0 | 0 | 0 | 1 | 1 | 782 |
| G# | 1 | 0 | 1 | 0 | 0 | 1 | 0 | 0 | 0 | 1 | 1 | 1 | 0 | 1 | 738 |
| G | 0 | 1 | 1 | 0 | 1 | 0 | 0 | 1 | 1 | 1 | 0 | 1 | 0 | 1 | 697 |
| F# | 1 | 1 | 1 | 0 | 0 | 1 | 0 | 0 | 1 | 0 | 0 | 1 | 0 | 1 | 658 |
| F | 0 | 0 | 0 | 1 | 1 | 0 | 1 | 1 | 0 | 1 | 1 | 0 | 0 | 1 | 621 |
| E | 1 | 0 | 0 | 1 | 0 | 1 | 0 | 1 | 0 | 0 | 1 | 0 | 0 | 1 | 586 |
| D# | 0 | 1 | 0 | 1 | 1 | 0 | 0 | 1 | 0 | 1 | 0 | 0 | 0 | 1 | 553 |
| D | 1 | 1 | 0 | 1 | 0 | 1 | 0 | 1 | 0 | 0 | 0 | 0 | 0 | 1 | 522 |
| C# | 0 | 0 | 1 | 1 | 1 | 0 | 1 | 1 | 0 | 1 | 1 | 1 | 1 | 0 | 493 |

In the Table 1, $R_{NO}$ represents a numerical value hereinafter referred to as "R number" obtained by an equation $$R_{NO}=FR10\times 2^9+FR9\times 2^8+\ldots +FR2\times 2^1+FR1\times 2^0$$

And these R numbers are determined for the respective notes by taking integers nearest to $13.56\times 10^{-6}\times 2^{15}\times f$, where f is a frequency of the note.

Assume, for example, that a note pulse $\phi_A$ corresponding to the note A is outputted from the ring counter 2. The encoder 11 produces, upon receipt of the note pulse $\phi_A$, a note code 0010 and the read-only memory 12 in turn produces frequency information 0111000011.

The output of the ring counter 2 may be directly applied to the read-only memory 12 instead of being encoded by the encoder 11. In this case, a read-only memory of a larger input bit number (in this case 12 in place of 4) should be employed.

The frequency information FR1 through FR10 read from the read-only memory 12 is applied to the digital Accordingly, pulses in a number equal to R number $R_{NO}$ corresponding to the frequency information $FR_A$ are delivered out of the carry output CR10 of the tenth stage during a time period of 13.56 microseconds$\times 2^{10}$. In the case of the note A, the number of the output pulses of the carry output CR10 is $2^9+2^8+2^3+2^2+2^1=782$ and the period of the pulses is $2^{10}/782\times 13.56$ microseconds$=17.76$ microseconds.

This signal with the pulse period of 17.76 microseconds is frequency divided by two in each of the eleventh through fifteenth stages of the tone generator 13 and a note frequency signal with a period of 17.76 microseconds$\times 2^5=568.2$ microseconds, i.e. with a frequency of $1/568.2\times 10^{-6}=1.760$ kHz, is delivered out from the output of the shift register 15 of the fifteenth stage.

This note frequency signal has a shape defining, when time division-demultiplexed, a frequency of the note $A_6$ (i.e. the note A in the highest octave). This note frequency signal is utilized as a tone signal for the tone $A_6$.

The output of the shift register SR15 is further frequency divided by two in each of the sixteen through nineteenth stages whereby note frequency signals corresponding to tones $A_5$, $A_4$, $A_3$ and $A_2$ (i.e. the notes A in the respective octaves other than the highest octave) are delivered out of the outputs of the shift registers SR16 through SR19 of the respective stages as tone signals.

Since the shift registers SR1 through SR19 of the digital tone generator 13 are operated in synchronism with the note pulses $\phi_C$ through $\phi_B$ of the ring counter 2, the shift registers SR15 through SR19 produces note frequency signals of the respective notes in the respective octaves on a time-division-multiplexed basis in synchronism with the note pulses $\phi_C$ through $\phi_B$.

The keyboard circuit 20 comprises matrix circuitry including note buses NL1 through NL12 respectively receiving the respective note pulses $\phi_C$ through $\phi_B$ from the ring counter 2 and representing the respective notes C through B and octave buses OL1 through OL5 respectively representing octaves to which the notes C through B belong. Each key switch is arranged to connect a note bus and an octave bus for a specific key together through a diode, so that the note bus is connected to the octave bus upon closing of the key switch caused by depression of the key and a note pulse representing the note of the depressed key is delivered out of the octave bus representing the octave to which the depressed key belongs. This output note pulse is supplied to the gate circuit 30 through one of terminals OC1 through OC5.

The gate circuit 30 is provided for gating the note pulses applied from the keyboard circuit 20 via the terminals OC1 through OC5 in response to the time-division multiplexed tone signals supplied from the time division multiplex tone source circuit 10. In the present embodiment, the circuit is so designed that both 4 foot (4') and 8 foot (8') register tones can be produced. To this end, the gate circuit 30 comprises AND gates $31A_1$, $31A_2$; $32A_1$, $32A_2$; $33A_1$, $33A_2$; $34A_1$, $34A_2$; $35A_1$ and OR gates 36, 37. In FIG. 2, the connection of input lines to the OR gates 36, 37 is expressed in a simplified manner. Actually, signals on lines which cross the input lines of the OR gate 36, 37 at points marked by small circles are all applied to the respective OR gates 36, 37. More specifically, the outputs of the AND gates $31A_2$, $32A_2$, $33A_2$ and $34A_2$ are applied to the OR gate 36, whereas the outputs of the AND gates $31A_1$, $32A_1$ $33A_1$, $34A_1$ and $35A_1$ are applied to the OR gate 37. The AND gates $31A_1$, $32A_1$, $33A_1$, $34A_1$ and $35A_1$ respectively receive corresponding one of the output signals of the shift registers SR19 through SR15 and corresponding one of the signals from the terminal OC1 through OC5 of the keyboard circuit 20. The AND gates $31A_2$, $32A_2$, $33A_2$ and $34A_2$ respectively receive corresponding one of the output signals of the shift registers SR18 through SR15 and corresponding one of the signals from the terminals OC1 through OC4 of the keyboard circuit 20. Consequently, the AND gates $31A_1$ through $35A_1$ and $31A_2$ through $34A_2$ are gated in response to the signals supplied from the keyboard circuit 20 in accordance with depression of keys.

Figure 3:
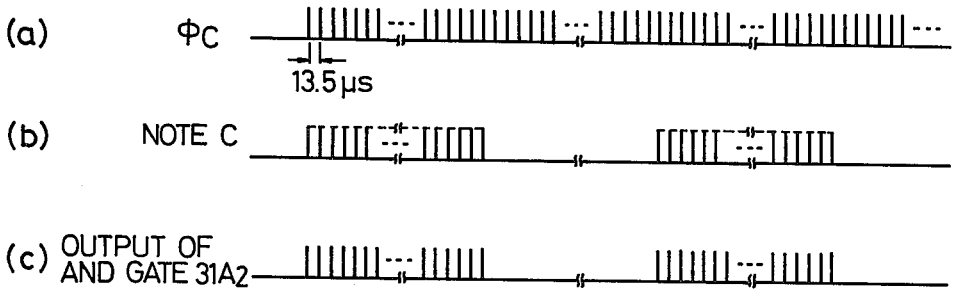
FIG. 3 is a timing diagram for explaining operations of some essential component parts shown in FIG. 2.

If, for example, a key for note $C_2$ which is the note C in the first octave has been depressed, the note pulse $\phi_C$ for the note C is delivered out of the terminal OC1 of the keyboard circuit 20 and the AND gates $31A_1$ and $31A_2$ are gated in synchronism with the note pulse $\phi_C$ for the note C. For convenience of explanation, description will now be made about the 4 foot register tone and the AND gate $31A_2$ associated therewith only. The AND gate $31A_2$ receives as its inputs the note pulse $\phi_C$ of a pulse period of 13.56 microseconds (frequency of 74 kHz) as shown in FIG. 3 (a) and a train of pulses from the shift register SR18 occurring at the time slot of the note C and having a frequency corresponding to the note C in the second octave (i.e. 4 foot register pitch for the first octave). In other words, signals occurring at time slots other than the time slot of the note pulse $\phi_C$ are inhibited by the AND gate $31A_2$ and a rectangular wave of a frequency corresponding to the note C in the second octave as shown by a broken line in FIG. 3(*b*) is substantially provided by the shift register SR18 (this rectangular wave is hereinafter referred to as a "rectangular wave signal"). Accordingly, the AND gate $31A_2$ selectively and cyclically gates out the note pulse $\phi_C$ and shown in FIG. 3(*c*) during each half period during which the square wave signal is "1".

If other key is depressed, a note pulse for the note of the key is likewise outputted from one of the terminals OC1 through OC5 corresponding to the octave to which the depressed key belongs and this note pulse is selectively and cyclically outputted in response to a corresponding square wave signal from the digital tone generator 13. Since the note pulses $\phi_C$ through $\phi_B$ are sequencially produced at different time slots, time slots of tones for keys of different note-names do not coincide with each other. Accordingly, the outputs of the AND gates $31A_2$ through $34A_2$ are provided as the 4 foot register tone signal from a terminal $T_{01}$ via the OR gate 36, whereas the outputs of the AND gates $31A_1$ through $35A_1$ are provided as the 8 foot register tone signal from a terminal $T_{02}$ via the OR gate 37.

The output from the terminals $T_{01}$ and $T_{02}$ are applied to the clock removal filter 40 (FIG. 1). The clock removal filter 40 consists, e.g., of a low-pass filter in which a non-audio high frequency is a cut-off frequency and functions to remove the note pulse component which is a high frequency component above an audio frequency, passing tone frequency components only. Accordingly, the output of the clock removal filter 40 is a tone frequency signal as shown by a broken line in FIG. 3(*b*) from which the note pulse component has been removed. The frequency of the note pulse is 74 kHz and this is fairly high compared with the tone frequency. Consequently, the level of the tone source frequency signal from which the note pulse component has been removed is relatively high resulting in an excellent S/N ratio.

Figure 4:
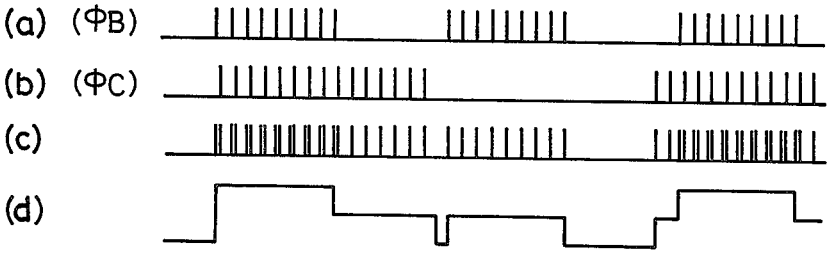
FIG. 4 is a timing diagram showing operations of some component part shown in FIG. 2 in a case where two keys are simultaneously depressed.

In a case where two or more keys have been depressed simultaneously, pulse signals having both wide and narrow pulse interval portions are provided from the terminal $T_{01}$ and $T_{02}$. Assuming, for example, that the keys for note C and note B are simultaneously depressed, generation of the tone signals for 4 foot tone from the terminal $T_{01}$ will now be described. In this case, the AND gate $31A_2$ produces pulse signals as shown in FIGS. 4(*a*) and 4(*b*) which are synchronized with the note pulses $\phi_B$ through $\phi_C$. These pulse signals are applied to the OR gate 36. Since the time slots allotted to these note pulses $\phi_B$ and $\phi_C$ differ from each other, the composite pulse signals provided from the terminal $T_{01}$ have a wide pulse interval portion and a narrow pulse interval portion as shown in FIG. 4(*c*). The output of the terminal $T_{01}$ is removed of its note pulse component through the clock removal filter 40 and forms an audio frequency signal whose level is high in the narrow pulse interval portion and low in the wide pulse interval portion. This signal is substantially equal in its waveform to a waveform obtained by superimposing the tone signal waveforms of the note C and B in an analog manner.

The tone signals thereafter are supplied to the tone color filter 50 and the volume control circuit 60 for tone color and loudness controls and then are supplied to the audio system 70 for production of musical tones.

What we claim is:

1. A polyphonic keyboard electronic musical instrument comprising:

a timing generator providing a repetitive set of time division multiplex timing signals, each signal in said set occurring at a unique time slot allotted to a particular corresponding musical note;

a numerical value generation circuit for generating numerical values corresponding to frequencies of respective notes on a time shared basis in synchronism with the multiplex timing signals for each corresponding note;

an adder circuit for implementing the cumulative addition of said numerical values for each of the notes at each time slot allotted to said note in synchronism with the multiplex timing signals for each such note and producing carry signals as results of the respective cumulative additions, the carry signals for each note also occurring in the time slot allotted to that note, the envelopes of the carry signals for each note constituting rectangular wave tone signals having frequencies established by the respective added numerical values and being multiples of the corresponding musical note frequencies;

frequency dividing means for producing rectangular tone wave signals in a plurality of octaves for each of said notes on a time shared basis by frequency dividing the carry signals, and a tone selection circuit for selecting by gating to an output the rectangular wave tone signal in the octave to which the note of a depressed key belongs from among said plural rectangular wave tone signals produced by said frequency divider means at the time slot corresponding to said note for the depressed key.

2. An electronic musical instrument as defined in claim 1 further comprising:

a clock removal filter for filtering out from said rectangular wave tone signals components at the time sharing frequency, a tone color filter for selectively filtering said rectangular wave tone signals within the audio range, and an audio system, said clock removal filter and said tone color filter being connected in series between said output and said audio system, said audio system amplifying said filtered rectangular wave tone signals to produce musical tones.

3. A polyphonic musical instrument comprising:

a multiplex timing generator producing a repetitive set of multiplex timing signals in respective time slots allotted to corresponding musical notes, note number supply means, cooperating with said timing generator, for providing in each respective time slot a note frequency related numerical value for the corresponding note, a time division multiplexed accumulator, synchronized with said timing signals, for cumulatively adding the numerical values for each respective time slot, carry signals being obtained from said accumulator for each time slot, a plurality of time division multiplexed dividers for sequentially dividing the carry signals for each corresponding time slot and thereby providing at each time slot a set of parallel outputs each comprising a pulse signal the envelope of which represents a rectangular tone wave signal for the note of the corresponding time slot, and in an octave established by the specific sequential divider which produces that output, a note and octave selection circuit comprising a plurality of gates each receiving a respective divider output, and a key switch matrix for connecting to an enable input of the gate associated with the divider providing outputs in a selected octave the multiplex timing signals for a selected note, said connected timing signals thereby enabling said associated gate to pass to a system output terminal the provided rectangular wave signal which corresponds to the selected note and octave.

* * * * *